United States Patent [19]

Thomas

[11] Patent Number: 4,685,603

[45] Date of Patent: Aug. 11, 1987

[54] FASTENER POSITIONING DEVICE

[76] Inventor: Edward L. Thomas, 7519 Dalebrook Rd., Independence, Ohio 44131

[21] Appl. No.: 847,193

[22] Filed: Apr. 2, 1986

[51] Int. Cl.[4] ..... B27F 7/02

[52] U.S. Cl. ..... 227/6; 227/113; 227/3

[58] Field of Search ..... 227/2, 3, 5–7, 227/113

[56] References Cited

U.S. PATENT DOCUMENTS

| | | | |
|---|---|---|---|
| Re. 29,855 | 12/1978 | Thomas | 221/263 |
| 3,285,489 | 11/1966 | Lingle | 227/113 |
| 3,747,828 | 7/1973 | Dupee et al. | 227/112 |
| 3,765,588 | 10/1973 | Frederickson | 227/113 |
| 4,030,655 | 6/1977 | Rothfuss et al. | 227/130 |
| 4,227,637 | 10/1980 | Haytayan | 227/8 |
| 4,370,093 | 1/1983 | Lund | 227/113 |

*Primary Examiner*—Donald R. Schran

*Assistant Examiner*—James L. Wolfe

*Attorney, Agent, or Firm*—Dority & Manning

[57] ABSTRACT

A fastener positioning apparatus includes a magnetized engaging element for slidably holding fasteners next to an elongated member as they are pushed from a first position into a hammering position by a positioning mechanism. In the hammering position, a hammering device seats the fastener into a desired medium. The entire fastener positioning apparatus may be placed on a cart for mobile use, and controlled so as to provide automatic placement of fasteners at predetermined intervals across the medium. Alternatively, manual control may be used instead of automatic control so that fasteners are positioned in accordance with specific selection of an operator. In the cart embodiment, a feed tube connects a tray for holding fasteners with a positioning device. The feed tube may include a vibrating device to ensure proper movement of the fasteners therethrough.

23 Claims, 10 Drawing Figures

FASTENER POSITIONING DEVICE

BACKGROUND OF THE INVENTION

This invention concerns an improvement to the fastener positioning device disclosed by the inventor's prior patent, U.S. Pat. Re. No. 29,855, reissued on Dec. 5, 1978. The types of fasteners generally used with the positioning device disclosed in U.S. Pat. Re. No. 29,855 and which may be used with the present invention have enlarged heads with shanks which extend therefrom. An exemplary use of such fasteners may be for securing roofing materials to a roof or the like. The disclosure of U.S. Pat. Re. No. 29,855 is herein expressly incorporated by reference.

In the device of U.S. Pat. Re. No. 29,855, fasteners are moved along a track from a feed bowl into a notch formed at the end of an elongated member. The side walls of the notch are open relative one end and one side of the elongated member so as to permit the passage of fastener shanks therethrough. Fasteners are placed into the notch through its side opening and are retained therein by a leaf spring. The entire elongated member including the notch associated therewith is slidably mounted on a housing. Reciprocation of the elongated member brings the notch with fastener retained therein into proximity with a hammering device having a magnetized hammering head. The fastener is then caused to exit through the end opening of the notch and become magnetically engaged with the hammering head. Operation of the hammering device then seats the fastener into a desired medium.

In such prior device, it is necessary for the fasteners to be fed through a track directly into a specific alignment with the notch and its leaf spring so that subsequent reciprocation of the elongated member will move each fastener into proper relationship with the magnetized head of a hammering device. If the fastener is not initially seated into such notch with the necessary alignment, it is unlikely that the device will accomplish its desired goal of properly advancing fasteners to a speific point in a given orientation suitable for automatic hammering.

Other prior art devices have shared the goal of properly feeding nails, fasteners or the like to a hammering position. Examples of such other prior art devices are disclosed by the following U.S. patents:

| U.S. Pat. No. | INVENTOR(S) | ISSUE DATE |
|---|---|---|
| 3,765,588 | Frederickson | October, 1973 |
| 4,030,655 | Rothfuss et al. | June, 1977 |
| 3,747,828 | Dupee et al. | July, 1973 |
| 4,227,637 | Haytayan | October, 1980 |

Frederickson utilizes a magnetic nail shaft aligning groove for attracting and retaining nails fed in seriatim to such groove by a delivery means. The nails are first magnetically engaged when received by the nail shaft aligning groove, and are not otherwise magnetically engaged along the length of a member as they are moved into a given hammering position. The remaining cited references utilize various techniques and apparatuses for positioning fasteners, but none which teach the present invetion. For example, Dupee discloses a system which utilizes fastener feed ducts both gravity and vacuum-actuated to feed fasteners to a desired position.

SUMMARY OF THE INVENTION

This invention improves the automatic handling of such fasteners, including their advancement relative an elongated member towards a given position for subsequent hammering into a desired medium. Such goal is in part accomplished by improved control and pre-handling of fasteners in an area where they are initially input to a positioning means for subsequent feeding to a hammering position, as discussed in greater detail below.

In general, a device in accordance with the present invention has an engagement means for movably engaging fasteners along the length of an elongated member. The elongated member is fixed relative a support frame, instead of being reciprocally mounted relative thereto as is the elongated member of the subject device of the Reissue patent discussed above. Positioning means are provided for moving fasteners along such elongated member as the engagement means maintains movable engagement between a fastener and the elongated member during such movement.

In accordance with teachings of this invention, engagement means may take the form of a magnet suitably mounted on the apparatus for slidably engaging the fasteners. In such embodiment, fasteners are continuously engaged magnetically while positioning means move or slide them along the length of an elongated member which is fixed relative a support member. In this manner, greater economy of motion is achieved in that only the fastener is moved, not the entire elongated member as in U.S. Pat. Re. No. 29,855.

In one form, a construction in accordance with teachings of the present invention comprises an apparatus for presenting in selected orientation a fastener of the type having an enlarged head with a shank extending therefrom, such apparatus comprising: a support frame; an elongated member received on the support frame; engagement means for engaging the fasteners along the length of such an elongated member; and positioning means for moving such fasteners along the elongated member from a first position relative the member to a second position relative the member. The second position may define a hammering position from which the fasteners are powered directly by a hammering device into a given medium.

More specifically, fasteners which are received in an open hopper or tray are moved into a track comprising a tube which descends on an angle from the hopper towards an engagement means. The tube in general may be partially opened so that portions of the fasteners such as their extended shanks protrude through openings in the track. A magnet mounted on or associated with the elongated member may perform the function of an engagement means in accordance with this invention, as specifically illustrated in the exemplary embodiment disclosed herewith. Of course, all funtional equivalents of such an embodiment for engagement means come within the scope of the teaching of the present engagement means in particular and the teachings of the present invention in general.

As a further embodiment of a construction in accordance with the teachings of the present invention, the hopper (or tray) and the entire support frame of a positioning apparatus may be rendered mobile with a cart-type adaptation. In such instance, a cam or its equivalent may be associated with movement of wheels of a mobile cart. Movement of the cam in response to rotational movement of the wheels may then be related to distances moved by the cart and used to establish a feedback signal for controlling operation of the fastener positioning device. Specifically, such a mobile-mounted apparatus can be controlled in response to rotational movement of the cart wheels so as to seat fasteners in a given medium at predetermined intervals. Alternatively, a manual input signal may be used in place of the cam signal for activating fastener positioning. In such manual mode, an operator would select the specific placement of fasteners and would trigger their being hammered into the desired medium.

A number of different but equivalent powering systems may be used to provide power for an apparatus constructed in accordance with the present invention. A pneumatic drive is an example of one particularly effective and preferred source to satisfy the power needs of the present invention. With such a pneumatic system, either of a manual control or a camming mechanism associated with a cart wheel may be readily adapted to close off air to a directional valve (i.e., controller) of a pneumatic cylinder. Operation of such cylinder may be arranged so as to move fasteners into a given position, such as from a defined first position relative a fixed elongated member into a defined second position, with such second position being a hammering position defined by a fastener being placed directly beneath an impact hammer for subsequent hammering. In such hammering position, a fastener may either continue to be held by engagement means associated with the elongated member, or may be released thereby and held by a magnet or other means associated with the hammering device.

In the pneumatic drive case, a reciprocating cylinder embodying a positioning means may be adapted to retract as air to a directional valve is closed off. A separate cam may be operatively associated with a predetermined-shaped control surface which is physically associated with the cylinder so that predetermined movement of the cylinder causes a hammering device to be activated. Activation of the impact hammer in turn drives or seats fasteners into a desired medium. The control cam may be further operatively associated with movement of a cylinder functioning as a positioning means such that other predetermined movement of the cylinder adjusts an air valve so as to cause the pneumatic hammering device to return to its raised position, ready for subsequent re-activation and consequent driving of fasteners into a medium.

Reciprocal movement of a positioning means in accordance with the present invention performs an additional function of holding fasteners back in a tube or supply means so that only one fastener at a time is fed to the first position and subsequently the hammering position. Such additional function is achieved by the positioning means (in all but its completely retracted position) blocking the exit end of the track or tube which feeds fasteners directly to the first position, defined relative the elongated member. The fasteners are supported by hanging in a partially open track or tube with their heads engaged by one opening therein and with a portion of their shanks protruding from a lower area of the track. When the positioning means cylinder is fully retracted, the forwardmost fastener in the feed track is freed (i.e., unblocked) to move from the feed track into operative association with the engagement means at the defined first position. Typically, this movement involves a fastener being brought into magnetic engagement with a magnet mounted on or near an elongated member. After such feeding, the fastener positioning device is generally prepared to repeat from that point a controlled cycle of driving, hammering and positioning fasteners.

An apparatus in accordance with the teachings of the present invention may omit the notch and associated leaf spring used in U.S. Pat. Re. No. 29,855 for first securing a fastener and then for being moved integrally with an elongated member so as to bring the fastener into a hammering position, at which point (if it is properly presented by the notch and leaf spring) it is transferred to a hammering device having a magnetic head. In contrast, this invention permits fasteners to be held in proper alignment as they are moved by a positioning means along the length of a fixed elongated member for desired delivery to a hammering position. With a single reciprocating stroke (an extension and subsequent retraction), a positioning means in accordance with this invention slides along the length of an elongated member fixed relative a support frame to place a fastener in a proper position and alignment to be hammered, while holding back other fasteners which are in seriatim received in a feed track for subsequent individual feeding to a defined first position.

Generally, it is an object of this invention to provide an improved fastener positioning device. It is a further object of this invention to provide a fastener positioning device having improved economy of movement with simultaneously increased reliability for positioning fasteners as desired.

Further, it is an object of this invention to provide a fastener positioning device having an engagement means for slidably engaging fasteners as they are moved along a relatively fixed elongated member.

Such objects recite only brief, general aspects of the present invention, and do not specifically recite numerous further objects and features of this invention, which features will be clear to and well understood by one of ordinary skill in the art upon considering and studying the following disclosure in conjunction with the accompanying figures. Furthermore, all functional equivalents of various elements and means of this invention which would occur to one of ordinary skill in the art are intended to come within the scope and spirit of the present invention, and are therefore included in the following description of the present invention and the scope of protection covering the same. Also, it should be understood when considering the following disclosure and exemplary embodiment that applicability of the present device is not limited to any particular kind or type of fastener. For example, it is not essential that a given fastener have a head portion which is enlarged.

BRIEF DESCRIPTION OF THE DRAWINGS

The structure and means including function thereof which form an exemplary embodiment of a construction in accordance with the present invention will be hereinafter described, together with other features thereof, wherein.

DETAILED DESCRIPTION OF A PREFERRED EMBODIMENT

Figure 1:
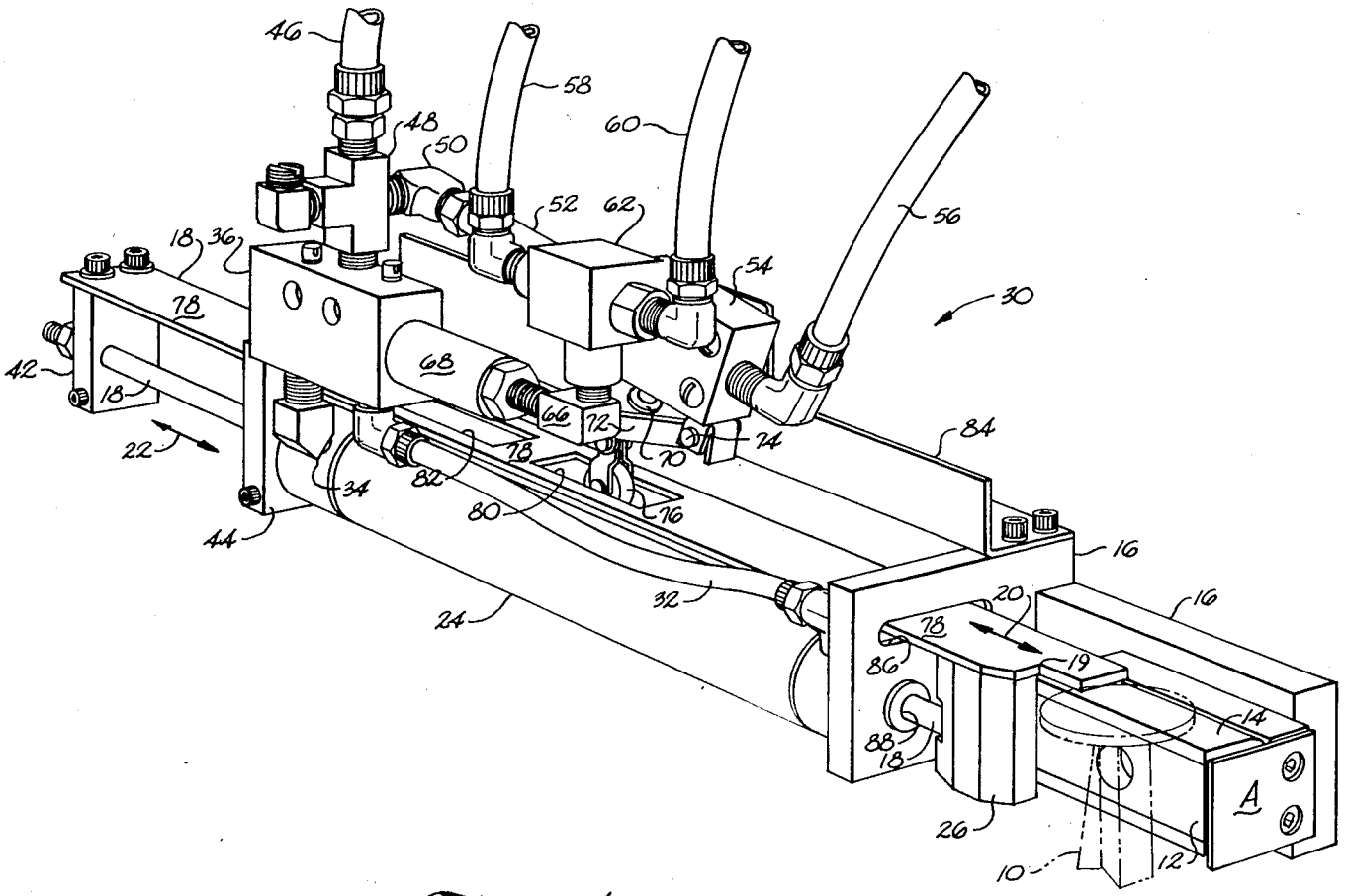
FIGS. 1, 2 and 3 are perspective, side and top views, respectively, of a portion of a fastener positioning device of such an exemplary embodiment.
Figure 2:
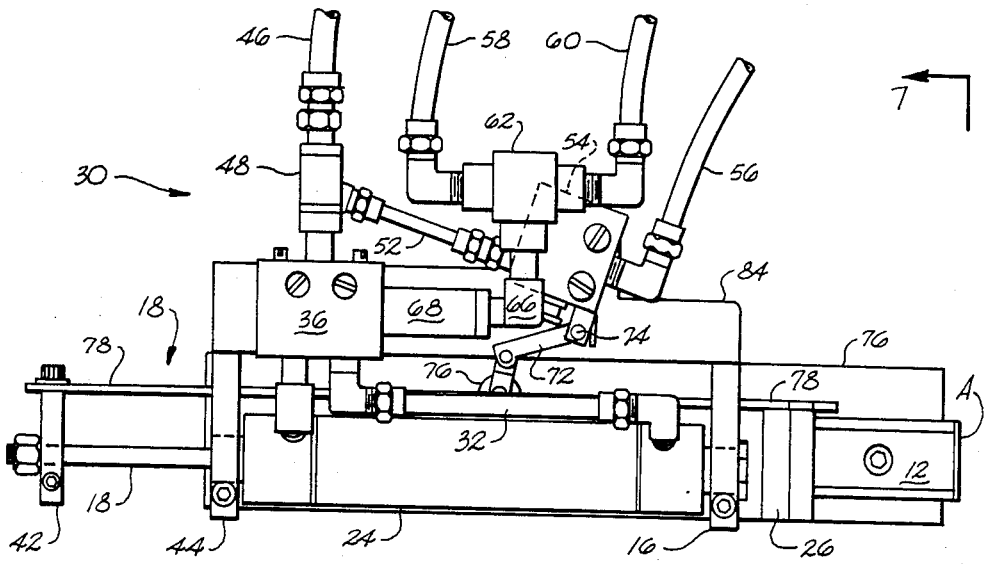
Figure 3:
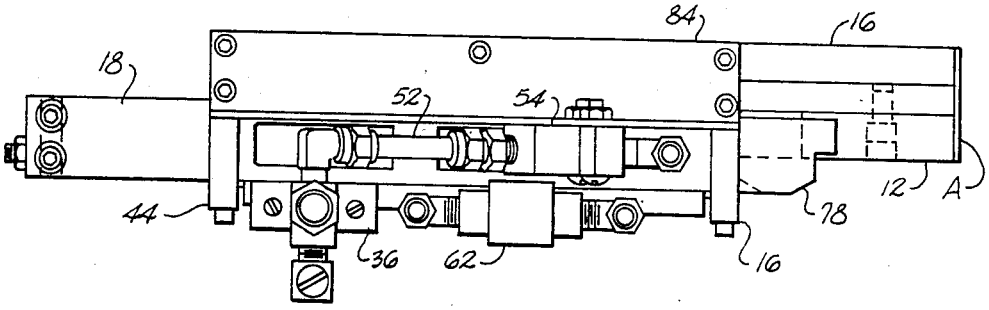

With reference to FIGS. 1–3, a typical metallic fastener 10 is shown in slidable engagement with a magnet 12 comprising an engagement means associated with elongated member 14. Elongated member 14 is fixed in relation with support frame 16. A given fastener 10 is moved along such fixed elongated member 14 by positioning means 18. Positioning means 18 is slidably mounted for reciprocal motion relative support frame 16, as indicated generally by arrows 20 and 22. Means 18 is shown in part as a piston and its associated pneumatic cylinder 24. Means 18 further includes a lengthwise control surface 78, discussed further below. Cylinder 24 is operated in a conventional manner to controllably reciprocate the piston portion of means 18, and with it, block head 26 mounted thereon and lengthwise control surface 78. Block head 26 is moved with the leading edge of means 18 to slidably push fasteners 10 from a first position (defined relative elongated member 14) along magnet 12 and fixed member 14 towards end A of fastener positioning apparatus 30.

For clarity, the dotted-line fastener 10 of FIG. 1 is illustrated in a position already somewhat displaced from the first position. In such first position, the lower side of the head of fastener 10 actually rests on the upper surface of control surface 78, and the shank of fastener 10 is brought into contact with the forward surface of block head 26. Such shank is, of course, also in contact with magnet 12. Essentially, the shank of fastener 10 is received in the lengthwise angle formed at point 19, with its head resting above on control surface 78.

Connecting tube 32 and connector 34 provide air inputs to power pneumatic cylinder 24 as is well known and understood by one skilled in the art without further detailed explanation. Directional valve 36 controls operation of cylinder 24 and may comprise any conventional pneumatic directional valve or its equivalent. The maximum distance between stopblocks 42 and 44 defines the maximum length of stroke possible. Air hose 46 provides input air to directional valve 36. Couplings 48 and 50 shunt a part of such input air from air hose 46 to another air hose 52 which provides input air to valve 54. Valve 54 and its output hose 56 may be associated with a hammering device, which is illustrated schematically in FIG. 10 and discussed in greater detail below.

Air hoses 58 and 60 provide, respectively, automatic and manual input control signals to switching valve 62, which may comprise a known pneumatic switching valve or any of its functional equivalents. In response to one or the other of positive inputs from air hoses 58 and 60, valve 62 provides a control output through connectors 64, 66 and 68 to directional valve 36 which in turn controls cylinder 24. In this manner, inputs at 58 or 60 can control reciprocation of pneumatic cylinder 24.

Valve 54 is controlled so as to activate a hammering device whenever valve button 70 associated therewith is depressed. Such depression can occur whenever cam follower arm 72 pivots upward about point 74 as cam follower wheel 76 rides upward on control surface 78 during reciprocation of pneumatic cylinder 24. Lengthwise control surface 78 includes a predetermined-shaped portion thereof which comprises a solid central member having two openings 80 and 82 on opposte sides thereof.

Valve button 70 is biased so as to remain in an outward or non-depressed position absent any counteracting or inward force. Due to such biasing, cam follower arm 72 is pushed downward whenever cam wheel 76 opposes (and enters) openings 80 and 82 of control surface 78. However valve button 70 is pushed upward (i.e., depressed) as cam wheel 76 rides up on the central portion of control surface 78. Whenever valve button 70 is so closed, valve 54 can control the hammering device to be activated and thereby hammer into a given medium a fastener which is being held in a defined hammering position. While cam switch 70 is open as illustrated in FIGS. 1 and 2, valve 54 and its output on air hose 56 maintain the hammering device in its retracted position. Control surface 78 may be provided integral with positioning means 18 for movement therewith, as discussed above. Therefore, in accordance with teaching of the present invention, control of a hammering device may be automatically associated with reciprocal movement of a positioning means. Such control is discussed in further detail below with reference to FIGS. 4–6.

Stop block 44 constitutes part of support frame 16, which frame also includes other elements such as general retainer element 84. Of course, numerous openings in frame 16 such as 86 and 88 make possible particular relative movements of elements as discussed throughout the specification. Such openings are readily apparent to and well understood by one skilled in the art upon studying the present Figures without requiring further detailed description.

Likewise, the numerous bolts which are illustrated in the Figures for joining various components of the present apparatus are generally not separately identified and discussed since they are fully disclosed by the present Figures, and their precise embodiments do not constitute essential or critical features of this invention. Furthermore, differing but equivalent embodiments of the present invention may be formed without departing from the spirit of same by providing various elements of the illustrated apparatus as integrally associated, rather than as individual elements secured together as specifically illustrated in the Figures. Any and all such embodiments and modifications which could be formed by integral association or separation or division of disclosed and illustrated elements are expressly included within the scope of the present invention by virtue of present reference thereto.

Figure 4:
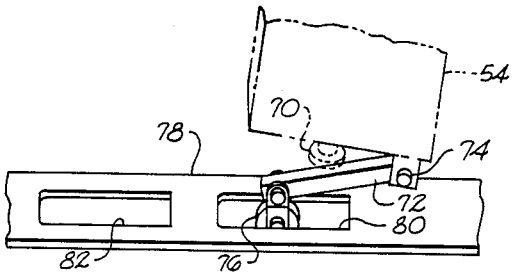
FIGS. 4–6 illustrate a plurality of relative positions which may be assumed by a cam mechanism, in operative association with a predetermined-shaped control surface of an exemplary positioning means, for establishing a control signal for a hammering device.
Figure 5:
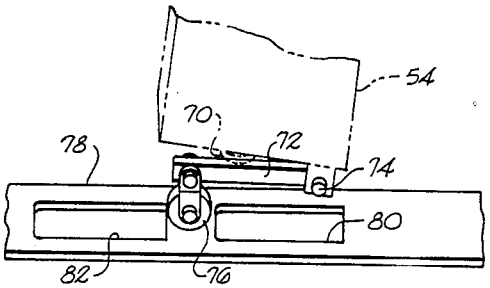
Figure 6:
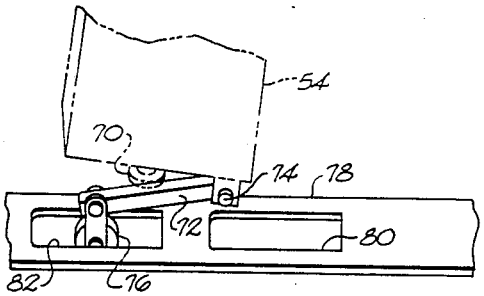

FIGS. 4–6 illustrate in enlarged detail the operation of cam wheel 76 in relation to control surface 78. Control surface 78 is formed integrally in the illustrated embodiment with elongated member 18 of FIG. 1 so that it is also reciprocated by the driving and controlled force of pneumatic cylinder 24.

FIG. 4 illustrates control surface 78 in its fully retracted position, as is the case in FIG. 1. In other words, means 18 and block head 26 have not yet begun to drive towards a fastener 10 magnetically secured to magnet 12 so as to push same outward towards end A of fastener positioning device 30. Push valve switch 70, pivot point 74 and cam follower arm 72 are biased such that cam wheel 76 is forced downward to extend partially through opening 80 of control surface 78 in the absence of any counter force.

As discussed above, whenever push valve 70 is open, as illustrated in FIGS. 1, 2, 4, and 6, a pneumatically driven hammering device is controlled through valve 54 and air hose 56 so as to remain in a retracted position. Actual embodiment of such pneumatic control of a hammering device in this instance may be accomplished with any conventional means, such as disclosed in the inventor's U.S. Pat. Re. No. 29,855, the teachings of which are specifically incorporated herein by reference relative pneumatic hammering devices and their control. Refer particularly to impactor 29 and its related discussion in such Reissue patent.

As is understood by those skilled in the art, whenever push valve 70 is depressed, a pneumatic control signal is fed via hose 56 to a hammering device to cause same to operate, i.e., impact fasteners properly positioned beneath a hammer head so as to drive them into a given medium. FIG. 5 illustrates such depression of valve switch 70. Control surface 78 may be moved towards end A of device 30 (to the right in FIG. 5) by movement of means 18 and head 26 under the driving force of cylinder 24. Fasteners 10 are moved to proper position beneath an impact hammer head so that cam follower wheel 76 riding up onto the central surface of control surface 78 between openings 80 and 82 thereof may cause subsequent hammering of such properly positioned fasteners.

The physical dimensioning of the overall device, e.g., the size of openings 80 and 82 and the length of travel of positioning means 18, are selected so that an impact hammering device is controllably powered to hammer fasteners into a given medium once they are placed in a determined hammering position by device 30. The actual length of displacement of the fasteners need only be sufficient to move fasteners in an efficient manner from their first position defined relative an elongated member into their defined second (i.e., hammering) position.

FIG. 6 illustrates cam follower wheel 76 having descended into opening 82 as control surface 78 is fully moved to the far right in the Figure while the positioning means completes placement of a fastener in the defined hammering position.

Considering FIGS. 4–6 in succession, one of ordinary skill in the art is fully instructed in the operation of the cam follower feature of this invention as positioning means are moved from their fully retracted position (FIG. 4) to a fully extended position (FIG. 6), representative of fasteners slidably moving (by means 18, surface 78 and block head 26) from a first position relative fixed elongated member 14 to a second (or hammering) position.

While the foregoing description of the Figures and the Figures themselves explain the physical interaction between control surface 78 and cam follower wheel 76 for a given preferred embodiment, a preferred hammering device is actually responsive to alternating positive signals (depressions of valve switch 70) so that hammering action takes place only during a return stroke of control surface 78. In other words, a complete cycle of movement for control surface 78 includes an advance stroke illustrated in series by FIGS. 4–6 and a retract stroke illustrated in series by FIGS. 6–4. For such an embodiment, FIG. 5 offers the best view of the practical consequences of such a retract stroke.

In a preferred embodiment, the hammering device would be controlled such that it would not respond to depression of switch 70 during the advance stroke of control surface 78, but instead would respond only to a FIG. 5 condition of valve switch 70 during a retract stroke of control surface 78. Various other embodiments may be envisioned and actually used by those skilled in the art for triggering a hammering device responsive to or synchronized with various movement and assumed positions of a positioning means, and all such other variations thereto fall within the broader teachings of this invention.

Figure 7:
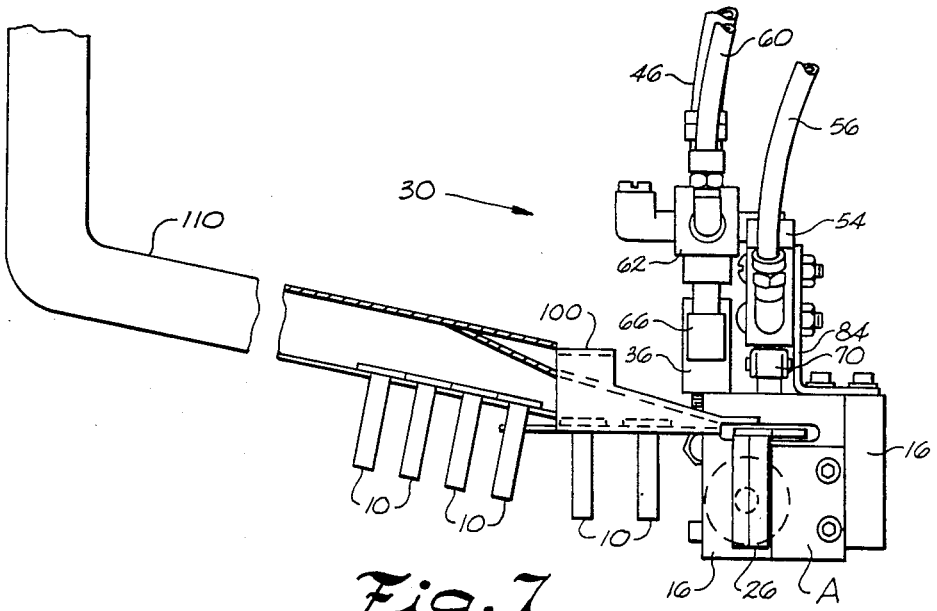
FIG. 7 illustrates an end view of the exemplary embodiment of this invention illustrated by FIGS. 1–3, in operative association with an example of a feeding mechanism in accordance with this invention, with typical fasteners for use with the present invention being also illustrated.

FIG. 7 illustrates a combination of feed track 110, nose piece 100 and fastener positioner 30 which further comprises a fastener positioning device in accordance with the present invention. Use in FIG. 7 of reference characters appearing elsewhere represent same or like elements earlier described, and hence it is not necessary to repeat description of all such elements of FIG. 7 in detail.

Fasteners 10 move within feed track 110 downward generally towards positioner 30. As illustrated in this particular embodiment (and shown more clearly in FIGS. 8 and 9), track 110 has an open slot in its lower surface to engage heads of fasteners 10 and to permit shanks of fasteners 10 to protrude therefrom. Fasteners 10 may move along track 110 under the force of gravity and as assisted generally by a vibrating means 120, illustrated and further discussed with reference to FIG. 10, below.

Nose piece means 100 generally functions to provide a physical bridge between feed track 110 and positioner 30. In this manner, fasteners are presented to a defined first position relative fixed elongated member 14. As explained above in conjunction with FIG. 1, such first position generally is defined by fastener shanks being received in the angle at point 19, with their heads resting on surface 78. Control surface 78 is in the position as illustrated by FIG. 4 whenever fasteners are actually placed from nose piece means 100 into such defined first position. Fastener 10 in phantom line in FIG. 1 is shown displaced from the above defined first position for the sake of clarity in illustrating the features of this invention. As positioning means 18 is moved so as to advance fasteners 10 from the first position to a hammering position, fasteners are held back in nose piece means 100 and feed track 110, until the positioning means is again fully retracted. At such time, another single fastener is moved into the first position and is prepared to be forwarded to a hammering position. Nose piece means 100 is described in more detail with reference to FIGS. 8 and 9.

Figure 8:
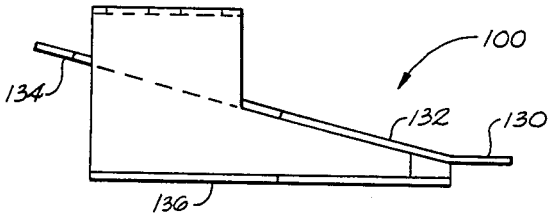
FIGS. 8 and 9 illustrate enlarged side and top views, respectively, of a nose piece portion of the feeding mechanism shown in FIG. 7 for bringing fasteners in seriatim into proper alignment with an engagement means and elongated member.
Figure 9:
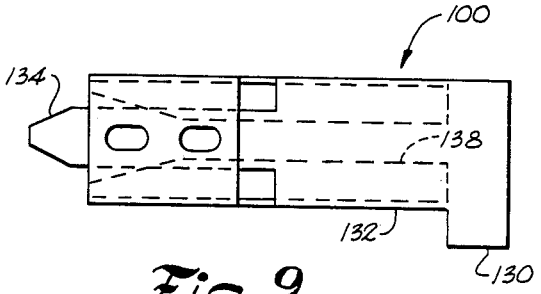

Referring now to FIGS. 8 and 9, nose piece means 100 generally includes a descending portion 132 and a horizontal portion 130. Horizontal portion 130 extends forwardly from descending portion 132 as shown in FIG. 9 so as to provide a fixed guide for fasteners as they are slidably held by engagement means 12 and moved by means 18, control surface 78 and block head 26 along the length of elongated member 14. Horizontal member 130 may actually be slightly depressed from horizontal as it advances forward of descending segment 132 so as to more tightly guide the heads of fasteners 10 as they advance towards end A of device 30.

As is illustrated by the dotted line representations of both FIGS. 8 and 9, heads of fasteners 10 are upwardly checked by a first member 134 while downwardly engaged by a lower member 136. Lower member 136 has a channel-like opening 138 centrally located therein which engages the heads of fasteners 10 while permitting the shanks thereof to descend therethrough. In this manner, fasteners are forwarded in a proper orientation with heads up and shanks down for being driven into a medium.

Figure 10:
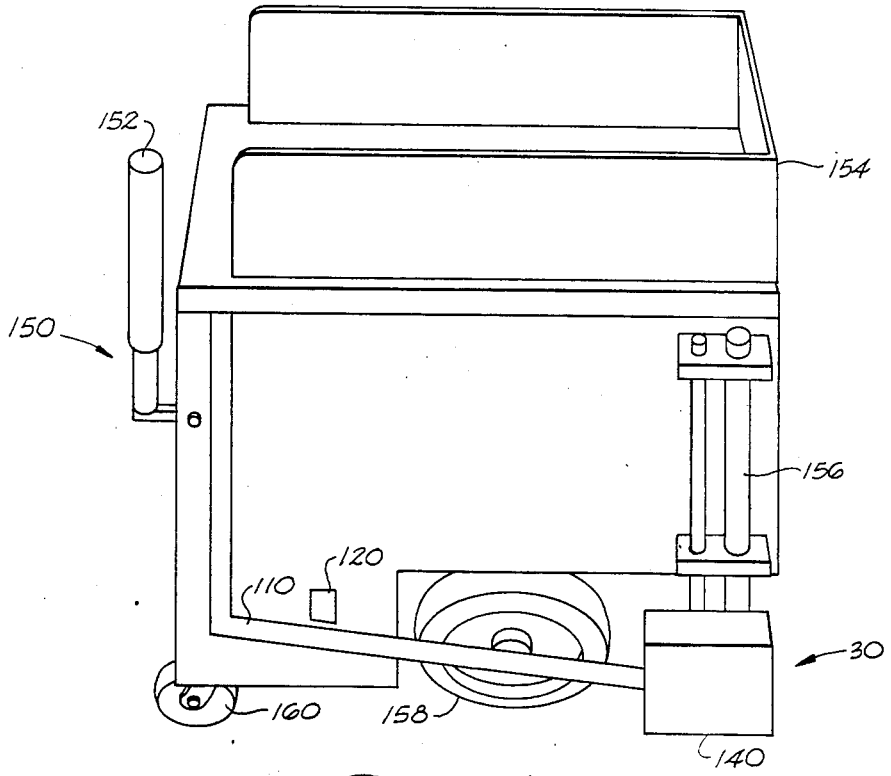
FIG. 10 is an overall perspective view showing a mobile cart embodiment of a fastener positioning device in accordance with the teachings of this invention.

FIG. 10 illustrates a mobile cart embodiment of a fastener positioning device in accordance with the present invention. Device 30 is secured behind a safety shield 140, as is the terminal end of feed tube 110. Vibrating means 120, for vibrating feed tube 110 to enhance movement of fasteners therein, are shown in block diagram form only since a more specific embodiment of such a well-known element is not essential for a proper understanding of this invention.

In general, FIG. 10 illustrates a cart 150 which has a handle 152 for pushing and controlling same, and a tray 154 for receiving and holding fasteners placed therein. The fasteners may be manually placed in tray 154 and then manipulated to pass through an opening (not shown) into feed tube 110. Tube 156 is schematically representative of a hammering device, exemplary details of which may be obtained from U.S. Pat. Re. No. 29,855, cited and discussed above.

In operation, cart device 150 is manually pushed along a medium in which fasteners are to be hammered. As cart 150 is pushed, wheels 158 and 160 thereof rotate. Using any one of a number of conventional techniques, it is possible to measure the rotational movement of a wheel of the cart, such as wheel 158, and relate same to distances traveled by cart 150. As particular distances or intervals of travel are sensed, automatic signals may be passed through hose 58 to cause fasteners to be automatically placed in the desired medium at predetermined intervals, such as designated inches or the like. Of course, manual control may be input through hose 60 to provide operator-selected placement of fasteners without regard to specific measured distances traveled by cart 150. Selectors for a specific distance for automatic placement and a control trigger for manual placement may be conveniently associated with cart 150, such as on handle 152 or the like.

While specific embodiments of the present invention have been particularly described to enable one of ordinary skill in the art to make and use the same, numerous variations of the present embodiments and functional equivalents thereof may be envisioned by one of ordinary skill in the art. All such variations and modifications, both those suggested above and all others, are intended to be included within the scope of the present invention, which is further described and limited only by the appended claims.

What is claimed is:

1. An apparatus for delivering fasteners to a hamxering device, each of said fasteners having a metal-based composition and a shank extending from a head thereof, said apparatus comprising:

a support frame;

an elongated member fixedly received on said support frame;

magnet means, fixedly supported along a longitudinal portion of said elongated member, for magnetically engaging said fasteners in slidable relationship with said member along at least a portion of the length thereof;

tube feed means for supplying said fasteners in a head-up, vertical disposition in seriatim to a first point relative said elongated mexber where their shanks are respectively engaged by said magnet means, said tube feed means approaching said point at an angle to the length of said elongated member; and reciprocating means for controllably sliding individual fasteners one at a time along said elongated member, is said vertical disposition with the shanks thereof engaged by said magnet means, from said first point to a hammering position relative a hammering device, while interrupting supplying of susequent fasteners to said first point by said tube feed means, whereby one fastener at a time is fed to said first point and then subsequently conveyed to said hammering position in a desired orientation for hammering.

2. An apparatus as in claim 1, further including a tray for receiving a plurality of said fasteners, said tube feed means connecting said tray with said first point, whereby fasteners are fed in seriatim from said tray to said first point.

3. An apparatus as in claim 2, wherein:

said tube feed means is formed at an angle which declines towards said first point; and said apparatus further includes vibrator means for vibrating said tube feed means so as to cause fasteners within said tube feed means to move towards said first point and be supplied thereto.

4. An apparatus as in claim 1, wherein said reciprocating means comprises a reciprocating cylinder having a head member thereon for pushing said fasteners along said elongated member from said first point toward said hammering position.

5. An apparatus as in claim 4, wherein said reciprocating cylinder is adapted to be controlled by one of manual and automatic control, and includes stop blocks to control the length of stroke thereof.

6. An apparatus as in claim 4, wherein the head member on said reciprocating cylinder holds back fasteners in said tube feed means until a fastener presently engaged by said magnet means is moved to said hammering position and said reciprocating cylinder is retracted.

7. An apparatus as in claim 1 wherein said support frame includes a mobile frame mounted on wheels.

8. An apparatus as in claim 7, wherein said reciprocating means is responsive to rotation of said wheels so as to selectively move said fasteners from said first point to said hammering position generally in relation to distances moved by said mobile support frame.

9. An apparatus as in claim 1, further comprising hammering means for controllably hammering fasteners conveyed said hammering position.

10. An apparatus as in claim 9, further including hammer control means for controlling said hammering means in response to operation of said reciprocating means.

11. An apparatus as in claim 10, wherein said hammer control means includes a hammer valve cam follower responsive to physical movement of said reciprocating means to automatically cause a hammer stroke and subsequent retraction of said hammering means.

12. An apparatus as in claim 1, wherein said take feed means further includes nose piece means associated therewith for guiding fasteners to said first point such that the heads thereof rest above an upper surface of said elongated member, and the shanks thereof are engaged by said magnet means.

13. An apparatus as in claim 1, wherein:

said tube feed means further includes nose piece means for presenting said fasteners to said first point such that the heads thereof rest above the upper side of said magnet means, and the shanks thereof are engaged along the length of said magnet means; and said reciprocating means further includes a reciprocating cylinder with a block head for pushing said fasteners along the length of said magnet means towards said hammering position, with said magnet means continuously engaging said fastener during such push movement.

14. An apparatus as in claim 1, wherein:

said support frame includes a tray for holding said fasteners and for being operatively associated with said tube feed means; and said tube feed means includes vibrating means for vibrating said tube feed means, whereby fasteners are advanced from said tray towards said first point.

15. An apparatus as in claim 1, wherein:

said support frame comprises a mobile frame on wheels; and said apparatus further includes control means, responsive to rotation of said wheels, for controlling the function of said reciprocating means whereby said fasteners are advanced to said hammering position at predetermined intervals of movement of said mobile frame indicated by said wheel rotation.

16. An apparatus as in claim 1, wherein:

said reciprocating means includes a predetermined shaped control surface for movement therewith; and said apparatus further comprises a cam follower means responsive to said control surface during operation of said reciprocating means for syncronizing operation of said hammering device with sliding of said fasteners by said reciprocating means, whereby said fasteners are hammered by said hammering device as they are in seriatim placed into said hammering position by said reciprocating means.

17. An apparatus as in claim 1, wherein said tube feed means includes nose piece means for supplying said fasteners to said first point such that said heads thereof rest above an upper surface of said magnet means with said shanks thereof magnetically engaging a side surface of said magnet means.

18. An apparatus as in claim 17, wherein said nose piece means includes:

an angled surface for bridging between said tube feed means and said elongated member, a level surface tangential thereto for establishing and maintaining said heads in proper association with said magnet means, and an extended portion integral with said level surface for further maintaining such orientation of said head as said reciprocating means slides said fasteners relative said elongated member.

19. A device for feeding to a hammering device fasteners of the type having an enlarged head with a shank extending therefrom, said device comprising:

a mobile support frame;

an elongated member fixedly mounted on said support frame and having a magnet along a portion thereof;

a feed tube for supplying said fasteners in seriatim to said magnet;

reciprocating cylinder means selectively powered for moving individual fasteners one at a time along said magnet towards said hammering device while temporarily interrupting tne supply of fasteners from said feed tube to said magnet; and cylinder powering means, responsive to movement of said mobile support frame, for controllably powering said reciprocating cylinder means so that fasteners supplied by said feed tube to said magnet are moved individually in series and presented one at a time to said hammering device to be subsequently hammered thereby.

20. A device as in claim 19, wherein:

said reciprocating cylinder means includes a control surface mounted thereon which is moved as said fasteners are moved; and said device further comprises a hammering control means, responsive to a cam follower interactive with said control surface as it is moved by said reciprocating cylinder means, for controlling operation of said hammering device in desired synchronism with presentation of said fasteners thereto.

21. A device as in claim 19, further including retract means, engaged by said reciprocating cylinder means as it moves said fasteners towards said hammering device, for causing said cylinder powering means to retract said reciprocating cylinder means.

22. A device as in claim 19, wherein said reciprocating cylinder means and hammering device are both pneumatically driven, and said cylinder powering means is also responsive to manual input signals for controllably powering said reciprocating cylinder means.

23. A device as in claim 19, further including in combination therewith said hammering device, said hammering device including a magnet on the end thereof for engaging the heads of fasteners selectively moved theretoward by said reciprocating cylinder means, wherein said fasteners so moved are released by said magnet of said elongated member so as to be magnetically engaged by said magnet of said hammering device.

* * * * *